US005552740A

United States Patent [19]

Casper

[11] Patent Number: 5,552,740

[45] Date of Patent: Sep. 3, 1996

[54] N-CHANNEL VOLTAGE REGULATOR

[75] Inventor: Stephen L. Casper, Boise, Id.

[73] Assignee: Micron Technology, Inc., Boise, Id.

[21] Appl. No.: 328,376

[22] Filed: Oct. 25, 1994

Related U.S. Application Data

[63] Continuation-in-part of Ser. No. 194,184, Feb. 8, 1994.

[51] Int. Cl.[6] ..... G05F 1/10; G05F 3/02

[52] U.S. Cl. ..... 327/541; 327/543; 327/546

[58] Field of Search ..... 327/530, 538, 327/540, 541, 543, 545, 546, 566; 323/314, 315

[56] References Cited

U.S. PATENT DOCUMENTS

| | | | |
|---|---|---|---|
| 4,349,778 | 9/1982 | Davis | 323/314 |
| 4,352,056 | 9/1982 | Cave et al. | 323/314 |
| 4,389,715 | 6/1983 | Eaton, Jr. et al. | 365/200 |
| 4,459,685 | 7/1984 | Sud et al. | 365/200 |
| 4,495,425 | 1/1985 | McKenzie | 327/541 |
| 4,795,918 | 1/1989 | Menon et al. | 327/540 |
| 5,105,102 | 4/1992 | Shioda | 327/541 |
| 5,373,226 | 12/1994 | Kimura | 327/541 |
| 5,410,241 | 4/1995 | Cecil | 323/315 |
| 5,416,363 | 5/1995 | Duesman | 327/546 |

OTHER PUBLICATIONS

D21 Mini–Stack DRAM (schematic) dated Aug. 18, 1993 (Micron Semiconductor, Inc.

*Primary Examiner*—Timothy P. Callahan
*Assistant Examiner*—My-Trang Nu Ton
*Attorney, Agent, or Firm*—Merchant, Gould, Smith, Edell, Welter & Schmidt

[57] ABSTRACT

A power-efficient power regulation circuit for use in semiconductor circuit powered by a power signal includes an N-channel transistor which provides a regulated power signal having a stabilized voltage level for use by the semiconductor circuit. A bias pull-up circuit is coupled to the gate of the N-channel transistor and arranged for biasing the N-channel transistor so that it normally conducts current, and a resistive circuit, including a resistive element arranged in series with a resistor-arranged P-channel transistor, is coupled to the source of the N-channel transistor and, in response to the regulated power signal, provides a feedback control signal. A voltage control circuit, coupled to the bias pull-up circuit and the resistive circuit, is activated to control the N-channel transistor in response to the feedback control signal. The voltage control circuit may include an enabling transistor which is activated to enable the voltage control circuit.

24 Claims, 5 Drawing Sheets

N-CHANNEL VOLTAGE REGULATOR

CROSS-REFERENCE TO RELATED APPLICATIONS

This is a continuation-in-part to U.S. patent application Ser. No. 08/194,184, entitled "*INTEGRATED CIRCUIT POWER SUPPLY HAVING PIECEWISE LINEARITY*," filed on Feb. 8, 1994 (Keeth, et al. ).

FIELD OF THE INVENTION

The present invention relates generally to semiconductor circuits and packaged integrated circuits, such as memory chips, data registers and the like. More particularly, the present invention relates to N-channel voltage regulators used in connection with such circuits and devices.

BACKGROUND OF THE INVENTION

A semiconductor circuit or logic device may be designed for any of a wide variety of applications. Typically, the device includes logic circuitry to receive, manipulate and/or store input data, and the same or modified data is subsequently generated at an output terminal of the device. Depending on the type of logic device and/or the circuit environment in which the device is used, the device may include a circuit for providing an internal power signal that is regulated and independent of fluctuations of the externally generated power input signal(s).

A DRAM (dynamic random access memory), formed as an integrated circuit (IC) is an example of such a data storage (or memory) device having an internal power signal circuit. Conventionally, the DRAM receives an external power signal (Vccx) having a voltage intended to maintain a voltage level (or range), for example, of 5 volts measured relative to common (or ground). Internal to the DRAM, a power regulation circuit maintains an internal operating voltage signal (Vccr) at a designated level, for example, of 3.3 volts. Ideally, Vccr linearly tracks Vccx from 0 volts to the internal operating voltage level (3.3 volts in this example), at which point Vccr remains constant as Vccx continues to increase in voltage or fluctuate above this level.

A number of previously-implemented semiconductor power-regulation circuits use a feedback-controlled P-channel transistor at the output of a control circuit, wherein the P-channel transistor is modulated once Vccx reaches the internal operating voltage level (3.3 volts), at which point Vccr remains constant as described above. This approach is disadvantageous, however, because the feed-back-controlled P-channel transistor acts in a manner similar to an operational amplifier whereby a substantial amount of current is consumed during normal operation.

One known approach for mitigating this problem is to implement the control circuit at the input of the P-channel transistor with a low-power standby mode. In this mode, the larger P-channel transistor is deactivated when the IC is not in use, so as to limit the excessive drain of drive current by the feedback-controlled P-channel transistor. Despite this limitation on current consumption, it is still desirable to reduce the overall level of current consumption. This is especially true for IC applications in which the IC is seldom not in use, in which case the beneficial contribution of the standby mode is nominal at best. Moreover, this standby approach introduces a delay to the operation of the IC, for example, during the transition from standby to normal. For fast-responding ICs, such an additional delay is undesirable and often unacceptable.

Accordingly, there is a need for a power regulation circuit which can be used in an IC without experiencing the above-mentioned deficiencies.

SUMMARY OF THE INVENTION

Generally, the present invention provides an improved arrangement for regulating a power signal in a semiconductor circuit.

In one particular embodiment, the present invention is implemented in the form of a power regulation circuit for use in a semiconductor circuit powered externally via a power signal having a voltage level measured with respect to common. The power regulation circuit includes: an N-channel transistor having a gate, a drain and a source, with the N-channel transistor providing a regulated power signal having a voltage level for use by the semiconductor circuit; a bias pull-up circuit coupled to the gate of the N-channel transistor and arranged for biasing the N-channel transistor so that it normally conducts current; a resistive circuit coupled to the source of the N-channel transistor and, in response to the regulated power signal, providing a feedback control signal; and a voltage control circuit, coupled to the bias pull-up circuit and the resistive circuit, for controlling the N-channel transistor in response to the feedback control signal.

The above summary of the present invention is not intended to present each embodiment or every aspect of the present invention. This is the purpose of the figures and the associated description which follows.

BRIEF DESCRIPTION OF THE DRAWINGS

Other aspects and advantages of the present invention will become apparent upon reading the following detailed description and upon reference to the drawings in which.

Figure 1A:
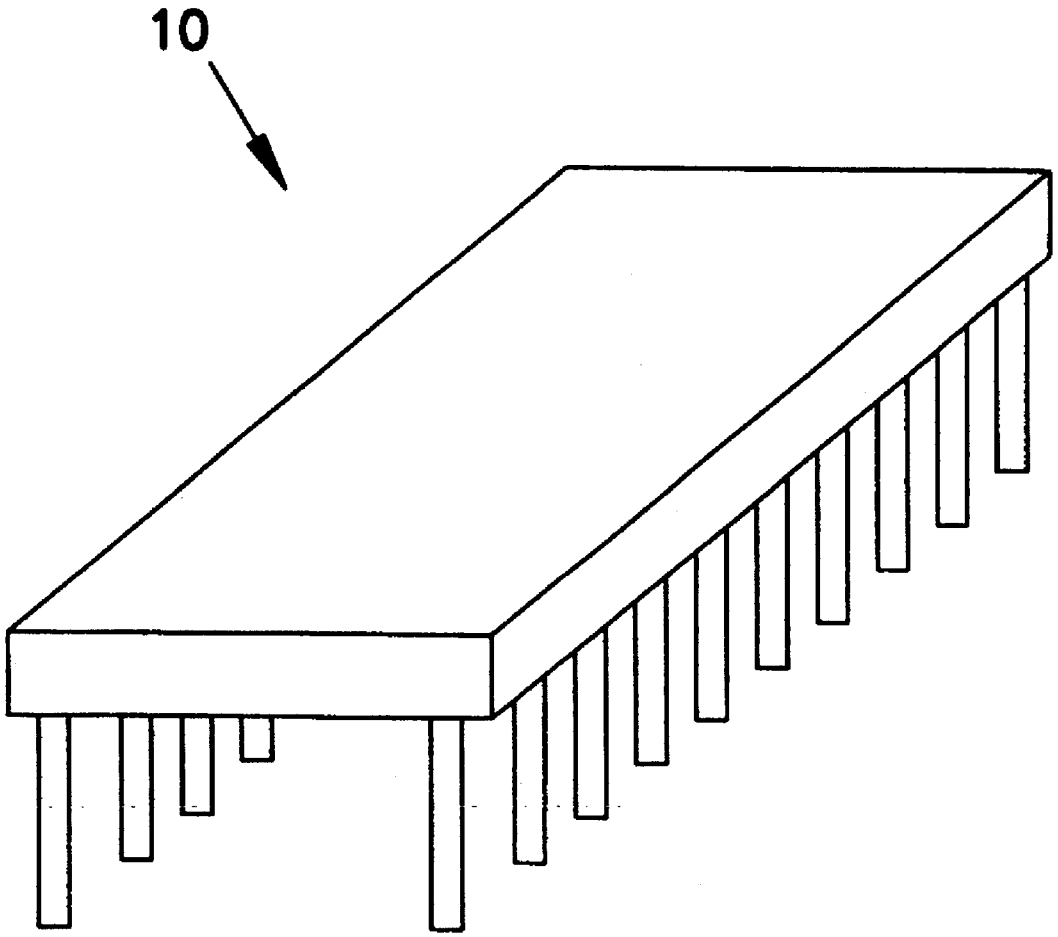
FIG. 1*a* is a perspective illustration of a semiconductor chip exemplifying a type of circuit device which may incorporate the principles of the present invention.

While the invention is susceptible to various modifications and alternate forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DETAILED DESCRIPTION OF THE DRAWINGS

Figure 1B:
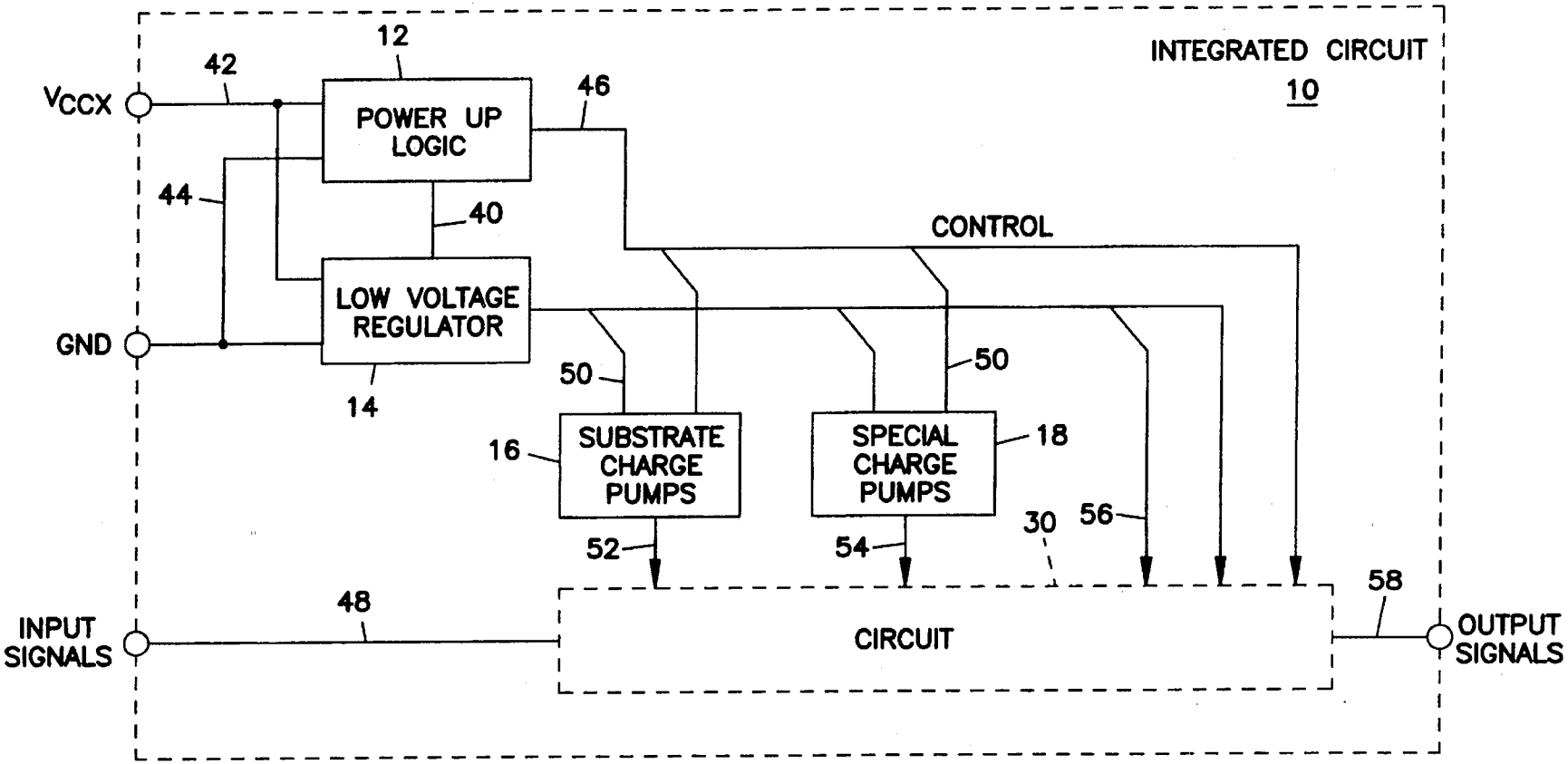
FIG. 1*b* is a block diagram of an exemplary arrangement and use of semiconductor circuit using a circuit implemented in accordance with the present invention.

The present invention has a wide variety of applications in semiconductor circuits requiring or benefiting from a power-efficient power regulation circuit. For instance, the present invention has application in connection with dynamic memory chips, microcomputers, and the like. Such semiconductor circuitry is often arranged in a semiconductor package, as illustrated in FIG. 1*a* by reference numeral 10. FIG. 1*b* illustrates an exploded view of the semiconductor package 10 in block diagram form. This exploded view depicts an exemplary arrangement and use of the power-efficient power regulation circuit, in accordance with the present invention.

More specifically, FIG. 1*b* represents an integrated circuit including a low voltage regulator, which embodies the principles of the present invention, and having conventional electrical circuit functions shown generally as circuit 30, connections for power signals 42 (Vccx), ground conductor 44 (GND), an input shown generally as input signal 48 and an optional output shown generally as output signal 58. As shown, the circuit 30 uses power and control signals for initialization and operation.

Power signals provided to the circuit 30 are derived from power signals 42. Voltages of power signals, for example Vccx, are conventionally measured relative to a reference signal, for example GND. A low voltage regulator 14 provides power signals 56, coupled to the circuit 30, and intermediate power signals 50, coupled as required to substrate charge pumps 16 and special charge pumps 18. Substrate charge pumps 16 and special charge pumps 18, which are conventional, respectively provide power signals 52 and 54, which are coupled to the circuit 30.

The low voltage regulator 14 receives power and control signals 40 provided by power up logic 12. The regulator 14 may also regulate elevated voltages or currents. Control signals 40 enable and govern the operation of the low voltage regulator 14. Similarly, control signals 46, provided by power up logic 12, enable and govern the operation of the substrate charge pumps 16 and special charge pumps 18. The sequence of enablement of these several functional blocks depends on the circuitry of each functional block and upon the power signal sequence requirements of the circuit 30.

The circuit 30 performs an electrical function of IC 10. In various embodiments, the circuit 30 is an analog circuit, a digital circuit, or a combination of analog and digital circuitry. Although the present invention is effectively applied where circuit 30 includes dynamic memory (DRAM), a static memory (SRAM), or a video memory (VRAM) having a serial port, the present invention can be beneficially applied to a number of other integrated circuits requiring an internal power regulator.

The conventional dynamic memory includes an array of storage cells. In a memory of the present invention, accessing the array for read, write, or refresh operations is accomplished with circuitry powered by voltages having magnitudes that may be different from the voltage magnitude of signal Vccx. These additional voltages are developed from the low voltage regulator 14.

Power to be applied to circuit 30 is conventionally regulated to permit use of integrated circuit 10 in systems providing power that, otherwise, would be insufficiently regulated for proper operation of the circuit 30. The low voltage regulator 14 includes a voltage reference and regulator circuit (not shown) having sufficient regulated output to supply signal Vccr, part of power signals 50.

Figure 2:
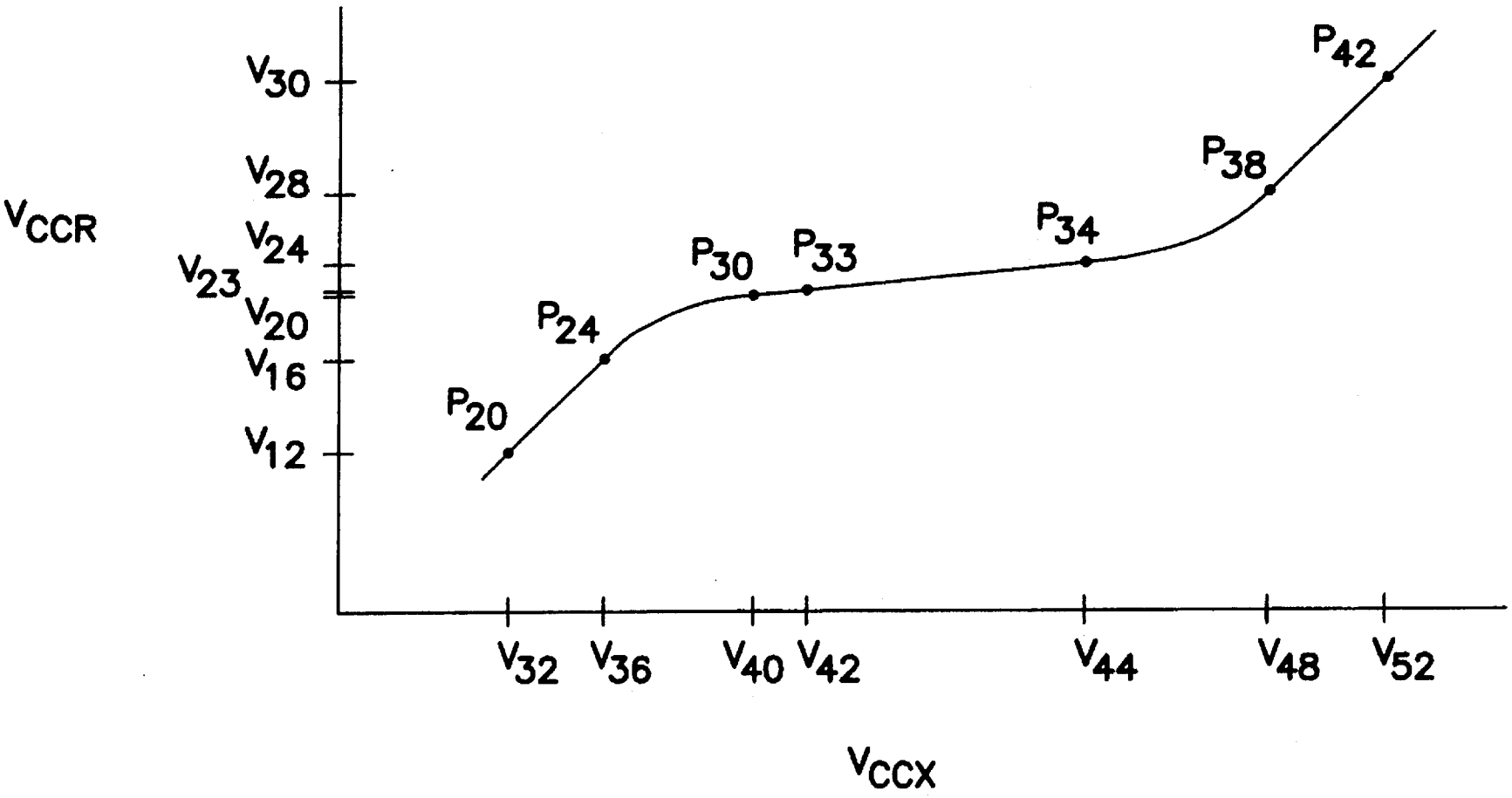
FIG. 2 is a graph of a piecewise linear relationship between a normal power signal (Vccx) and a power signal (Vccr) conditioned or regulated in accordance with the present invention.

FIG. 2 is a graph of a piecewise linear relationship between Vccx and Vccr. As shown, Vccr is a monotonic function of Vccx, wherein portions of the function can be approximated by linear segments having nonzero slope. The relationship between Vccx and Vccr along one of these segments is characterized by a nonzero constant. When restricted to a range of values for Vccx, for example, the bounded range from $V_{40}$ to $V_{44}$, Vccr is in proportional relation to Vccx, wherein the mathematical relation is dominated by a nonzero constant of proportionality, i.e., the slope of the segment from $P_{30}$ to $P_{34}$.

In a first segment from $P_{20}$ to $P_{24}$, Vccr approximates a (diode) level just below Vccx for efficient low voltage operations. The voltage of Vccr is proportional to the voltage of the power signal Vccx when the voltage of the power signal does not exceed a threshold voltage, $V_{36}$. In an embodiment of integrated circuit 10 that includes dynamic random access memory, operation in the first segment provides data retention at low power consumption. The slope of the first segment in such an embodiment is set to about unity.

In a second segment from $P_{30}$ to $P_{34}$ used for normal operations of the integrated circuit, Vccr rises gradually with Vccx so that test results at the edges of the segment can be guaranteed with a margin for measurement tolerance, process variation, and derating. The voltage of Vccr is proportional to the voltage of the power signal Vccx when the voltage of the power signal exceeds a threshold voltage, $V_{40}$, which is greater than $V_{36}$. In an embodiment of integrated circuit 10 that includes dynamic random access memory, operation in the second segment supports speed grading individual devices with a margin for properly stating memory performance specifications.

In conventional regulator circuitry, an attempt is made to optimize for elimination Vccr variation over the range of voltages of Vccx from $V_{40}$ to $V_{44}$, i.e., a zero slope for the second segment. In the present invention, a nonzero slope is employed so that tests can be conducted at conditions known to be outside (greater than) the range of voltages for Vccx to be specified.

As an example of the utility of a nonzero slope for the second segment, consider DRAM maximum access time specification testing. For a particular device, access time when Vccx corresponds to $V_{30}$ will be greater than access time when Vccx corresponds to $V_{33}$. By testing all devices at Vccx corresponding to $V_{30}$, maximum access time can be guaranteed in the range $V_{33}$ to $V_{34}$ with a margin for test tolerance variation, operating temperature variation, and similar variables and derating factors.

In a third segment from $P_{38}$ to $P_{42}$, Vccr follows below Vccx at a predetermined constant offset. The offset is defined as the voltage difference between Vccx and Vccr. As shown, the offset ($V_{48}$–$V_{28}$) is equal to the offset ($V_{52}$–$V_{30}$). Operation in the third segment supports screening at elevated temperatures for identifying weak and ineffective memory devices.

Above and below the threshold or control voltage, transitions between segments are smooth in the embodiments discussed below. This is due to the use of an N-channel transistor and surrounding control circuitry in the power supply circuitry. Conventional power supply circuits used in integrated circuit on-chip regulators employ switching circuits, for example, for selecting a regulator reference voltage when increasing Vccx from the second to the third segments.

Figure 3:
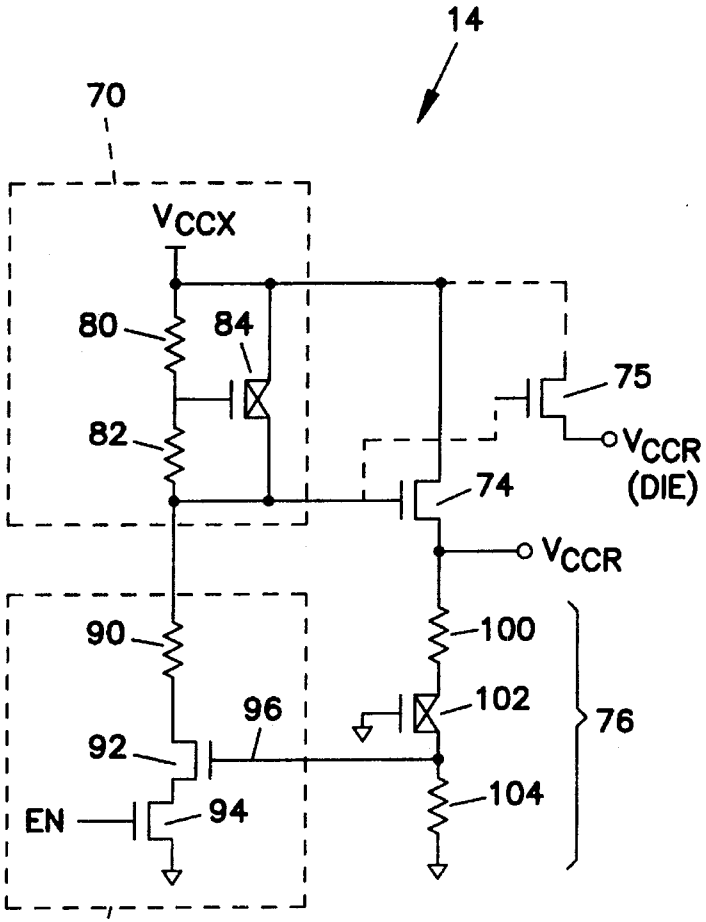
FIG. 3 is a detailed schematic of a first embodiment of a power regulation circuit implemented in accordance with the principles of the present invention.

FIG. 3 illustrates one of the above-mentioned embodiments of the low voltage regulator 14 of FIG. 1*b*, according to the present invention. The regulator 14, which is based around N-channel transistor technology (in this embodiment N-channel transistor 74), provides a conditioned or regulated power signal Vccr in response to Vccx. Using N-channel transistor technology (in contrast to P-channel or equivalent transistor technology) substantially reduces power consumption for all modes of operation.

The low voltage regulator 14 may be viewed as including four primary circuit areas. These are a bias control circuit 70, a biasing pull-down circuit 72, the N-channel transistor 74, and a level sensing circuit 76.

The bias control circuit 70 provides a bias activation signal for the transistor 74 by pulling up the gate of the transistor 74 in the direction of the power signal (Vccx), via resistors 80 and 82, with a transistor 84 forcing prompt activation of the transistor 74 upon power up.

The biasing pull-down circuit 72, which consists of a current-limiting resistor 90 and N-channel transistors 92 and 94, is arranged to deactivate the transistor 74 in response to a feedback control signal, provided by the level sensing circuit 76. The feedback control signal is provided on lead 96 and controls the gate of the transistor 92. The transistor 94 is normally active (or conducting current), and is responsive to an externally provided enable signal, which is used for testing purposes.

The N-channel transistor 74 and the level sensing circuit 76 operate in unison, with the level sensing circuit 76 responding to voltage level at the source of the N-channel transistor exceeding a predetermined threshold level. The level sensing circuit 76 reduces the voltage sensed at the source of the transistor 74 using a voltage-divider arrangement, with a first resistance provided by a resistor 100 in combination with a temperature-stabilizing P-channel transistor 102 and a second resistance provided by a second resistor 104. In response to the N-channel transistor exceeding a predetermined threshold level, the level sensing circuit provides the feedback control signal to activate the transistor 92, which in turn biases the gate of, and momentarily deactivates, the transistor 74. In this manner, the N-channel transistor 74 provides the regulated power signal, Vccr.

Another important advantage of the present invention is that it permits the inclusion of an optional N-channel transistor 75, which may be connected to the control (gate) input of the N-channel transistor 74 to provide an isolated regulated power signal, Vccr(Die), for another purpose. For example, this second isolated signal may be used as the regulated voltage for the entire die embodying the circuit 14.

Figure 4:
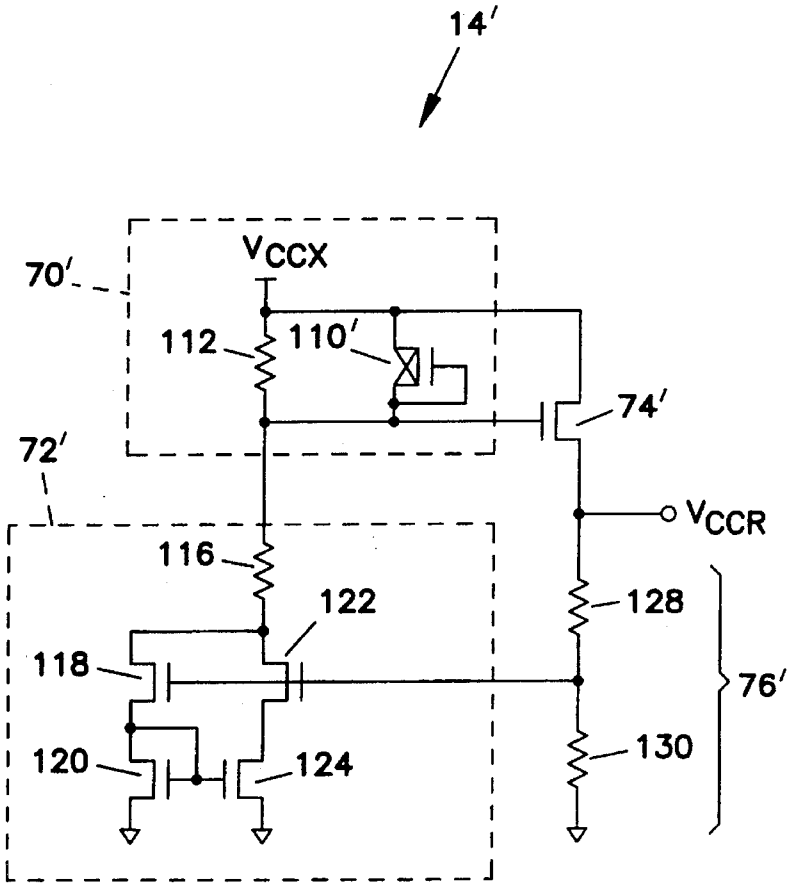
FIG. 4 is a detailed schematic of a second embodiment of a power regulation circuit implemented in accordance with the principles of the present invention.

Turning now to FIG. 4, a second embodiment 14' of the power regulator circuit is illustrated, with the bias control, biasing pull-down and level sensing circuits shown in modified form, depicted respectively as 70', 72' and 76'. The bias control circuit 70' includes a diode-arranged P-channel transistor 110 and a pull-up resistor 112, each connecting to the gate of the N-channel transistor 74'. The biasing pull-down circuit 72' includes a current-limiting resistor 116 connected to the gate of the transistor 74' and four N-channel transistors 118, 120, 122 and 124 arranged to form a pair of current mirrors. The current mirror arrangement provides an increased gain and, therefore, a fast response to the level sensing circuit 76' generating the feedback control signal between resistors 128 and 130. The source of transistor 118 is connected to the interconnected gates of the transistors 120 and 124 to lessen the time period before the transistors 120 and 124 are activated in response to the feedback control signal.

Figure 5:
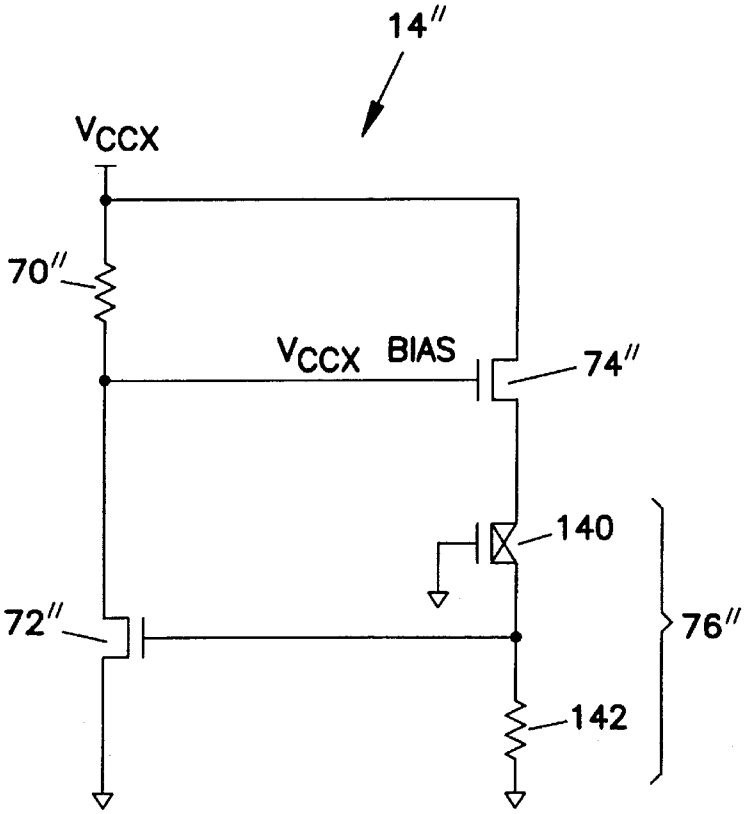
FIG. 5 is a detailed schematic of a third embodiment of a power regulation circuit implemented in accordance with the principles of the present invention.

FIG. 5 illustrates a third, component-reduced embodiment 14" of the power regulator circuit having similarly-arranged bias control, biasing pull-down and level sensing circuits. The bias control circuit, in this instance, consists of a resistor 70" connected to the gate of the N-channel transistor 74", so as to provide a Vccr bias until the biasing pull-down circuit, consisting of N-channel transistor 72", overcomes the bias and disables the transistor 74". As with the circuit arrangements of FIGS. 3 and 4, the level sensing circuit 76" provides a feedback control signal to activate the pull-down circuit. The level sensing circuit 76" is implemented as a voltage divider, with a P-channel transistor 140 and a resistor 142, reducing the voltage presented via the source of the transistor 74" to the N-channel transistor 72".

Figure 6:
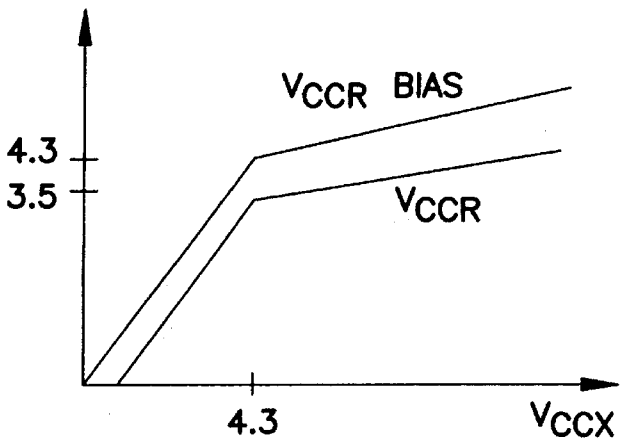
FIG. 6 is another graph showing a piecewise linear relationship between a normal power signal (Vccx) and a power signal (Vccr) conditioned or regulated in accordance with the present invention.

The operation of each of the illustrated power-regulator embodiments may be further understood by viewing the circuits of FIGS. 3–5 in conjunction with the plot of FIG. 6, which is a plot showing how VccrBias and Vccr change as Vccx increases.

The first plot, Vccr, is shown to increase with Vccx from a voltage level slightly greater than 0, linearly at a slope of about 1, until Vccx reaches 4.3 volts. When Vccx reaches 4.3 volts, the slope of the plot substantially decreases, almost to the ideal 0 slope level. At this 4.3-volt Vccx threshold, the Vccr voltage becomes regulated via the feedback control provided from the level sensing circuit to the pull- down circuit, which in turn controls the activation of the N-channel transistor in conjunction with the bias control circuit.

The second plot is of VccrBias, which corresponds to the signal at the gate of the N-channel transistor. Like the first plot, Vccr increases from 0 volts with Vccx, linearly at a slope of about 1, Vccx reaches 4.3 volts. When Vccx reaches 4.3 volts, the slope of the plot substantially decreases, to the same effective slope as Vccr. In this second plot, however, VccrBias remains about 0.8 volts greater than the voltage level of Vccr. Thus, while Vccr flattens when it reaches 3.5 volts, VccrBias flattens when it reaches 4.3 volts.

The foregoing description, which has been disclosed by way of the above examples and discussion, addresses preferred embodiments of the present invention encompassing the principles of the present invention. The embodiments may be changed, modified and/or implemented using various circuit types and arrangements. For example, the pull-up and pull-down circuits controlling the respective gates of the Vccr-providing N-channel transistors may be implemented using various forms of active and/or passive circuits, and the respective circuits providing the feedback control signal may be implemented in a number of modified forms. In addition, the Vccr-providing N-channel transistors may be implemented using various types of known and equivalent modified N-channel structures. Those skilled in the art will readily recognize that these and various other modifications and changes may be made to the present invention without strictly following the exemplary embodiments and applications illustrated and described herein, and without departing from the true spirit and scope of the present invention which is set forth in the following claims.

What is claimed is:

1. A semiconductor circuit device powered by a power signal having a voltage level measured with respect to common, comprising:

a logic circuit; and a power regulation circuit providing the logic circuit with a regulated power signal, the power regulation circuit including a bias control circuit providing a bias activation signal in the direction of the power signal, a feedback control signal, a biasing pull-down circuit arranged in series with the bias control circuit and common, the biasing pull-down circuit activated in response to the feedback control signal, a level sensing circuit, an N-channel transistor having a gate terminal coupled to the bias control circuit, having a drain terminal coupled to the power signal, and having a source terminal coupled to the level sensing circuit, the N-channel transistor activating in response to the bias activation signal exceeding a threshold level and providing the regulated power signal, and the level sensing circuit responding to activation of the N-channel transistor, providing the threshold level, and generating the feedback control signal for controlling activation of the N-channel transistor.

2. A semiconductor circuit device, according to claim 1, wherein the level sensing circuit includes a voltage divider circuit having an upper portion and a lower portion, the upper and lower portions being interconnected at a junction.

3. A semiconductor circuit device, according to claim 2, wherein the feedback control signal and the threshold level are provided at the junction of the voltage divider circuit.

4. A semiconductor circuit device, according to claim 3, wherein the biasing pull-down circuit includes a current-passing switch arranged to pass current in response to the feedback control signal.

5. A semiconductor circuit device, according to claim 4, wherein the current-passing switch includes a transistor.

6. A semiconductor circuit device, according to claim 1, wherein the level sensing circuit includes a voltage divider circuit having an upper portion and a lower portion, the upper portion comprising a resistor.

7. A semiconductor circuit device, according to claim 1, wherein the level sensing circuit includes a voltage divider circuit having an upper portion and a lower portion, the lower portion comprising a resistor.

8. A semiconductor circuit device, according to claim 1, wherein the level sensing circuit includes a voltage divider circuit having an upper portion and a lower portion, the upper portion comprising a transistor arranged to provide a predetermined level of resistance and the lower portion comprising a resistor.

9. A semiconductor circuit device, according to claim 8, wherein the upper portion further includes a resistor arranged in series with the transistor.

10. A semiconductor circuit device, according to claim 1, further including another N-channel transistor controlled in response to the biasing pull-down and level sensing circuit and providing another isolated regulated power signal.

11. A semiconductor circuit device, according to claim 1, wherein the biasing pull-down circuit does not include a differential amplifier.

12. A power regulation circuit for use in semiconductor circuit powered by a power signal having a voltage level measured with respect to common, comprising:

an N-channel transistor having a gate, a drain and a source, the N-channel transistor providing a regulated power signal having a voltage level for use by the semiconductor circuit;

a bias pull-up circuit coupled to the gate of the N-channel transistor and arranged for biasing the N-channel transistor so that it normally conducts current;

a resistive circuit coupled to the source of the N-channel transistor and, in response to the regulated power signal, providing a feedback control signal; and a voltage control circuit, coupled to the bias pull-up circuit and the resistive circuit, the voltage control circuit controlling the N-channel transistor in response to the feedback control signal.

13. A power regulation circuit, according to claim 12, wherein the bias pull-up circuit includes a resistor coupled between the power signal and the gate of the N-channel transistor.

14. A power regulation circuit, according to claim 12, wherein: the bias pull-up circuit includes a first resistive-element, second resistive-element and a P-channel transistor arranged and interconnected to bias the N-channel transistor to conduct current promptly after power is provided to the semiconductor circuit; and the voltage control circuit includes a transistor arranged to conduct current in response to the feedback control signal.

15. A power regulation circuit, according to claim 14, wherein the voltage control circuit includes an enabling transistor arranged to conduct current in response to an enable control signal.

16. A power regulation circuit, according to claim 12, wherein the bias pull-up circuit further includes: a P-channel transistor having a gate, a source and a drain, the source being connected to the power signal; a first resistive element having one end connected to the power signal, and having another end connected to the gate of the P-channel transistor; a second resistive element having one end connected to said one end of the first resistive element and the gate of the P-channel transistor, and having another end connected to the gate of the N-channel transistor, to the voltage control circuit and to the drain of the P-channel transistor.

17. A power regulation circuit, according to claim 12, wherein the voltage control circuit does not include a differential amplifier.

18. A power regulation circuit for use in semiconductor circuit powered by a power signal having a voltage level measured with respect to common, comprising:

an N-channel transistor having a gate, a drain and a source, the N-channel transistor providing a regulated power signal having a voltage level for use by the semiconductor circuit;

a bias pull-up circuit coupled to the gate of the N-channel transistor and arranged for biasing the N-channel transistor so that it normally conducts current;

a resistive circuit, including a resistive element and a resistor-arranged P-channel transistor arranged in series with the resistive element, coupled to the source of the N-channel transistor, and, in response to the regulated power signal, providing a feedback control signal; and a voltage control circuit, coupled to the bias pull-up circuit and the resistive circuit, the voltage control circuit controlling the N-channel transistor in response to the feedback control signal and including an enabling transistor arranged to conduct current in response to an enable control signal.

19. A power regulation circuit, according to claim 18, wherein the voltage control circuit does not include a differential amplifier.

20. A power regulation circuit for use in semiconductor circuit powered by a power signal having a voltage level measured with respect to common, comprising:

an N-channel transistor having a gate, a drain and a source, the N-channel transistor providing a regulated power signal having a voltage level for use by the semiconductor circuit;

a bias pull-up circuit coupled to the gate of the N-channel transistor and arranged for biasing the N-channel transistor so that it normally conducts current;

the bias pull-up circuit including a P-channel transistor having a gate, a source and a drain, the source being connected to the power signal; a first resistive element having one end connected to the power signal, and having another end connected to the gate of the P-channel transistor; a second resistive element having one end connected to said one end of the first resistive element and the gate of the P-channel transistor, and having another end connected to the gate of the N-channel transistor, to the voltage control circuit and to the drain of the P-channel transistor;

a resistive circuit including a resistive element arranged in series with a resistor-arranged P-channel transistor, coupled to the source of the N-channel transistor, and, in response to the regulated power signal providing a feedback control signal;

and a voltage control circuit, coupled to the bias pull-up circuit and the resistive circuit, the voltage control circuit controlling the N-channel transistor in response to the feedback control signal and including an enabling transistor arranged to conduct current in response to an enable control signal.

21. A semiconductor circuit device powered by a power signal having a voltage level measured with respect to common, comprising:

a logic circuit; and a power regulation circuit providing the logic circuit with a regulated power signal, the power regulation circuit including a bias control circuit providing a bias activation signal in the direction of the power signal, a feedback control signal, a biasing pull-down circuit arranged in series with the bias control circuit and common, the biasing pull-down circuit activated in response to the feedback control signal, a level sensing circuit, a transistor circuit including an N-channel transistor having a gate terminal coupled to the bias control circuit, having a drain terminal coupled to the power signal, and having a source terminal coupled to the level sensing circuit, the transistor circuit activating in response to the bias activation signal exceeding a threshold level and providing the regulated power signal, and the level sensing circuit responding to activation of the N-channel transistor, providing the threshold level, and generating the feedback control signal for controlling activation of the N-channel transistor.

22. A semiconductor circuit device according to claim 21, wherein the transistor circuit further includes another transistor coupled to the bias control circuit and arranged to provide the regulated power signal.

23. A semiconductor circuit device according to claims 22, wherein said other transistor is an NMOS transistor have a gate terminal coupled to the bias control circuit, a drain terminal coupled to the power signal, and a source terminal providing the regulated power signal.

24. A semiconductor circuit device, according to claim 21, wherein the biasing pull-down circuit does not include a differential amplifier.

* * * * *